US005938242A

United States Patent [19]

Ryan

[11] Patent Number: 5,938,242

[45] Date of Patent: Aug. 17, 1999

[54] MULTIPLE MEDIA STORAGE DEVICE FOR BOOK LEAF STRUCTURE

[76] Inventor: Jennifer L. Ryan, 1322 Lake Victoria Dr., Lake Worth, Fla. 33461

[21] Appl. No.: 08/867,713

[22] Filed: Jun. 2, 1997

[51] Int. Cl.[6] ..... B42D 1/00

[52] U.S. Cl. ..... 281/38; 402/79; 206/307

[58] Field of Search ..... 281/15.1, 21.1, 281/38, 51; 402/79; 206/309, 311, 312, 387.1, 389.13, 387.15, 307

[56] References Cited

U.S. PATENT DOCUMENTS

| | | | |
|---|---|---|---|
| D. 316,107 | 4/1991 | Lockner | D19/20 |
| 4,493,650 | 1/1985 | Kaufmann, III et al. | 434/178 |
| 4,577,889 | 3/1986 | Schulz | 281/15 R |
| 4,714,275 | 12/1987 | Engel et al. | 281/15 R |
| 4,752,230 | 6/1988 | Shimizu | 434/317 |
| 5,031,935 | 7/1991 | D'Andrea | 281/15.1 |
| 5,049,078 | 9/1991 | Thomsen | 434/178 |
| 5,190,316 | 3/1993 | Hefty | 281/15.1 |
| 5,213,507 | 5/1993 | Ozrovitz | 434/178 |
| 5,316,404 | 5/1994 | Hensel | 402/79 |
| 5,387,107 | 2/1995 | Gunter | 434/238 |
| 5,490,739 | 2/1996 | Olson | 402/79 |
| 5,501,540 | 3/1996 | Ho | 281/38 X |
| 5,513,914 | 5/1996 | Faber | 383/10 |
| 5,524,932 | 6/1996 | Kalisher | 283/67 |
| 5,620,271 | 4/1997 | Bergh et al. | 281/38 X |
| 5,713,683 | 2/1998 | Bergh et al. | 281/38 X |
| 5,782,349 | 7/1998 | Combs | 281/38 X |

*Primary Examiner*—Willmon Fridie, Jr.
*Attorney, Agent, or Firm*—John C. Smith

[57] ABSTRACT

A multiple media storage device for attachment to a conventional book leaf. The device includes a two dimensional storage compartment and/or a three dimensional storage compartment which has an optional data entry area associated with the storage compartments. The data entry area is a writing area provided for entry of printed information on the device. The device is attached to a conventional book leaf via a substrate that holds the integral storage compartments and data entry areas and adheres to the surface of the book leaf. An alternative embodiment integrates the device into a book leaf structure. The book leaf structure may have multiple devices on a single page, each of which may hold two and/or three dimensional items in combination with data entry areas for printed information related to objects in the storage compartments. The storage compartments may be transparent to allow viewing of the contents without opening the storage compartment. Optional leaf structures provide storage compartments which are exposed on both sides of the leaf to allow viewing the contents of the storage compartment from both sides. The storage compartments may be sealed such that the contents of the storage compartments are protected from environmental damage.

9 Claims, 6 Drawing Sheets

MULTIPLE MEDIA STORAGE DEVICE FOR BOOK LEAF STRUCTURE

BACKGROUND OF THE INVENTION

1. Technical Field

The present invention relates to book leaf structures. In particular, it relates to integral storage compartments for storage of multiple media types which can be attached to a conventional book leaf or fabricated as a book leaf having an integral multiple media storage compartments. The multiple media types include two dimensional and/or three dimensional storage compartments and data entry areas associated with the storage compartments.

2. Background Art

A popular application for books which allows the user to write personal information in the book is a diary. While many individuals maintain diaries, they are not able to keep important items that may relate to the diary entry in the book. As a result, these items become separated and perhaps lost. In the case of delicate items, such as flowers from special occasions, etc., the items can be easily destroyed. Further, the prior art diaries do not provide the ability to ensure that items, such as the flowers discussed above, are not lost or separated from the diary. It would be advantageous to have a diary which allows the user to make personal entries while at the same time providing secure storage for related items.

In addition to diaries, many business activities would benefit from the ability to integrate storage of two or three dimensional items in combination with written information such that the written information and physical items would not become separated and such that the physical items could be visually examined without the wear and tear associated with handling. One such activity is the organization of collectibles. Fragile items such as stamps could be easily damaged by mishandling. Even items which have relatively durable structures, such as coins, can be devalued by handling if the oils from a user's hand oxidizes the metal. The prior art has failed to provide a secure integral storage device capable of integrating one or more collectibles with a written description that can be updated by the user to form a complete sample of the item in question and then allowing items to be combined and organized to form a complete collection. It would be advantageous to have a device capable of organizing collectibles in such a manner.

Another activity is the organization and storage of evidence for legal uses. It is important to secure evidence properly to ensure that it is not damaged or altered. Also, the ability to store the evidence with a written description would be valuable for future use, since it would prevent accidental mishandling caused by someone who did not understand the significance of the item. In addition, legal issues often require the use of multiple items. As the number of items increases, the possibility that individual items may be lost or damaged increases. Further, it becomes increasingly difficult to organize evidence as the number of evidence samples grows. The prior art has failed to provide a secure integral storage device capable of integrating one or more items of evidence with a written description to form a complete evidence record and then allowing multiple evidence records to be combined and organized to form a complete record of a case. It would be advantageous to have a device capable of organizing evidence in such a manner.

In like manner, samples or specimens for medical or scientific uses are also more useful when combined with written descriptions. The ability to organize samples and make notes that will be secured to the sample container ensures that information will not be accidentally separated from the samples at a later time. In addition, scientific observation often requires that an object be observable from all angles. The prior art has failed to provide a device which secures a sample, provides an attached description field, and allows samples to be viewed from both front and rear.

The prior art has also attempted to use books to teach and/or provide entertainment. One type of book which has been used for both of these purposes is the sticker book used by small children. This book structure provides a child with a book that has blank areas and a collection of associated stickers. As the child reads the book, stickers related to the story are placed in the book at the appropriate blank spaces. The advantage of this book structure is that it increases the child's attention and interest in the book due to its interactive nature. However, since the stickers can be used only once, the advantage of this technique is lost after the first use.

Another book structure which has similar purposes is the book which has pre-printed names or information. This structure is intended to increase a child's interest by incorporating the child's name and other personal information. For example, the name of the child's pet, the child's address and age, etc., may be used in conjunction with a standard story shell to produce a book which appears to be custom written for the child. This book structure enhances the child's interest in the story due to the personal nature of the presentation. The drawback to this structure is that it does not allow any interactivity and is not modifiable once completed.

One known book structure, that attempts to provide similar benefits, uses photo retainers to hold a photo of the child. This increases the child's interest by making the book more personalized. The photos used with the book can be selected to coincide with the particular story line (i.e., facial expression, clothing worn in the photo, etc). An additional advantage is provided if the photo retainer can be easily used by the child. If the child replaces the photos in the book, then the interactive nature of the book will increase the child's attention and further encourage use of the book.

In the area of general education, the prior art has not provided a convenient method of combining text with physical samples for study and/or experimental purposes. When studying a particular field, it is often advantageous to be able to make notes on an ongoing basis. For example, the ability to update a description as changes in the sample are observed can be important for a particular experiment. The prior art has failed to provide an integrated device capable of organizing and maintaining experiment samples with integral description fields that can be altered at the user's convenience.

While providing some examples of using book structures as interactive devices, the prior art has focused on book structures which are inflexible in that they are designed to hold information which not alterable once entered. Further, the prior art books are designed to hold two dimensional objects such as photos, but do not provide the ability to simultaneously hold two and three dimensional objects, allow viewing from both sides, and allow information to be entered regarding objects stored in the book.

SUMMARY OF THE INVENTION

The present invention solves the foregoing problems by providing a multiple media storage device for attachment to a conventional book leaf. The multiple media storage device includes a two dimensional storage compartment and/or a three dimensional storage compartment which has an optional data entry area associated with the storage compartments. The multiple media storage device is attached to a conventional book leaf via a substrate which holds the integral storage compartments and data entry areas and adheres to the surface of the book leaf. The multiple media storage device includes attachment means, such as adhesive, to attach it to a conventional page leaf. An alternative embodiment integrates the device into a book leaf structure. The book leaf structure may have multiple media storage devices on a single page, each of which may hold two and/or three dimensional items in combination with a data entry area for printed information related to objects in the storage compartments. The storage compartments may be transparent to allow viewing of the contents without opening the storage compartment. Optional leaf structures provide storage compartments which are exposed on both sides of the leaf to allow viewing the contents of the storage compartment from both sides. The storage compartments may be sealed such that the contents of the storage compartments are protected from environmental damage.

DESCRIPTION OF THE PREFERRED EMBODIMENT

For ease of discussion, the device will be referred to as a multiple media storage device for use with a book leaf structure. For the purposes of this disclosure, the term "multiple media storage" refers to the storage of three dimensional, two dimensional, and written data in a single device. Those skilled in the art will recognize that the device can be used in a variety of ways which differ from those traditionally used by a conventional book. While it can be used as a conventional book, it can also be used as an interactive book which provides incentive for young readers and studies. Further, it can be used for a variety of storage and categorization needs, such as organization and display of legal evidence, organization and display of medical and scientific samples, presentation of collectibles, etc. In fact, it is suitable for any application which requires storage of two or three dimensional objects, and the attachment of written descriptions of those objects such that the written description and the objects do not become separated.

Figure 1:
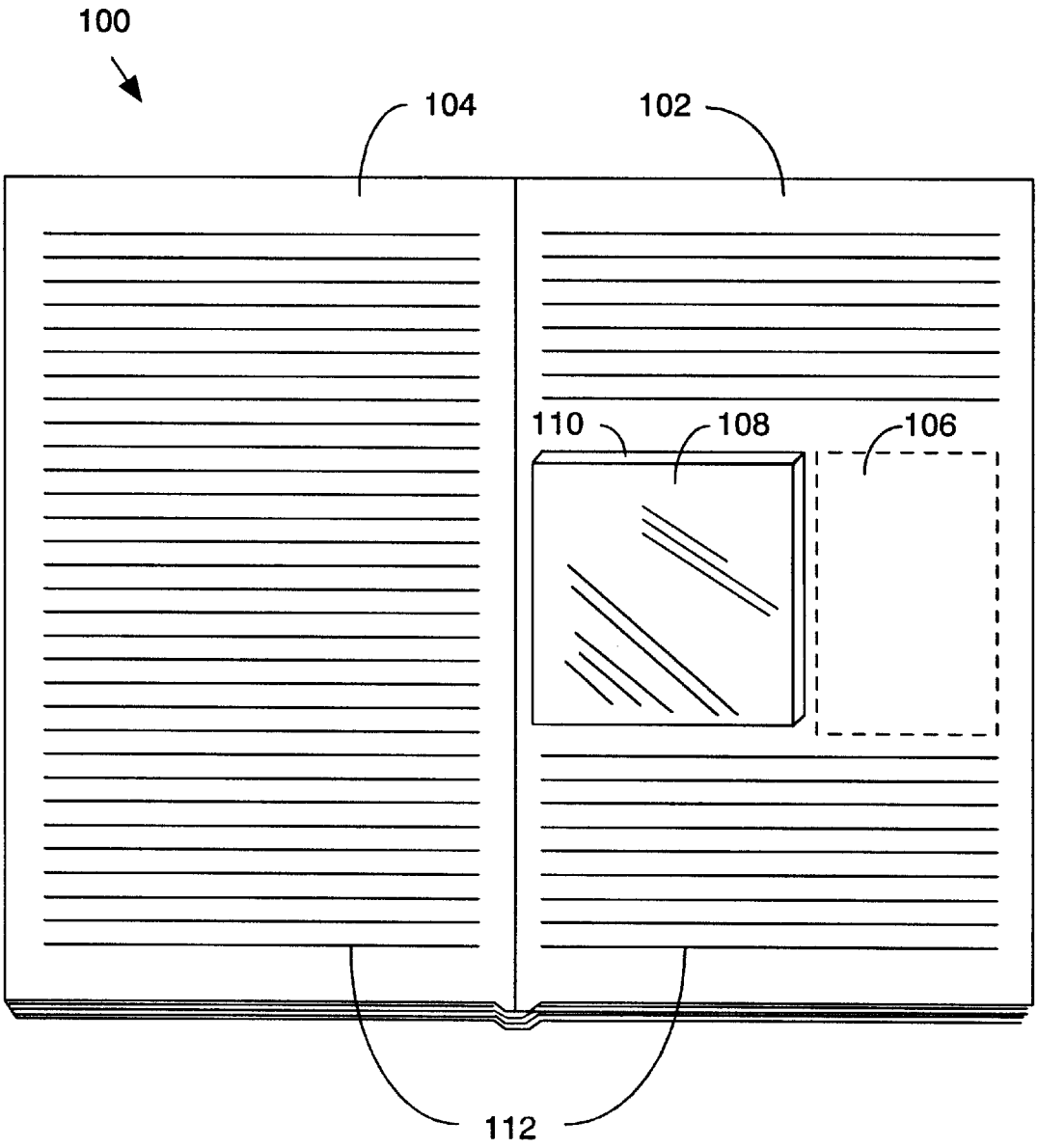
FIG. 1 is a preferred embodiment of the device showing the integral storage compartment and the data entry field.

Referring to FIG. 1, this figure shows a preferred embodiment of a book 100. In this figure, book 100 shows a conventional book leaf 104 and the integral leaf 102 used by the invention. The device may have preprinted text 112 on either conventional book leaf 104 or on integral leaf 102. The integral leaf 102 has a storage compartment 108 for the storage and display of objects. Storage compartment 108 can be fabricated from a variety of materials such as plastic, polyethylene, polypropylene, etc. Preferably, a transparent material will be used to allow viewing the objects without requiring their removal from storage compartment 108. Therefore, any suitable material can be used to fabricate storage compartment 108 in addition to those listed above. Storage compartment 108 can be secured to integral leaf 102 by any suitable means, such as adhesive, etc.

Storage compartment 108 also has optional access port 110 which is designed to allow the user to insert objects. In the preferred embodiment, storage compartment 108 is expandable to hold not only flat objects such as photos, but is also capable of holding three dimensional objects. Those skilled in the art will recognize that storage compartment 108 can also be fabricated to hold only objects which are substantially two dimensional (such as a photo), or be fabricated with an object pre-sealed within storage compartment 108. However, these variations limit the capability of the book 100.

Also shown is data entry field 106. Data entry field 106 can be a blank area, a lined area etc. It provides a space for entering data related to the object in storage compartment 108. By entering data in this manner, the data is never separated from the object. The benefits of using the integral leaf 102 can be shown for multiple activities.

In the case of a diary, an entry related to a special event, such as a high school prom, can be entered next to the storage compartment 108 which may contain the corsage worn by the writer. This provides a secure storage area for a delicate three dimensional item which may otherwise be lost.

In the case of a collectible (such as a stamp, coin, baseball card etc.), an entry related to the stored object, such as its history or condition, can be entered next to the storage compartment 108. This ensures that information related to that particular item is not mislaid.

Likewise, evidence stored for legal purposes can be placed in the storage compartment 108 with a description of its significance written next to it. This helps to avoid the situation where evidence is contaminated in some fashion because the person handling it does not understand its significance.

The printed text 112 is especially useful for scientific or teaching purposes. For example, when teaching subjects such as biology, samples of items such as leaves, seashells etc, can be placed in storage compartment 108 for viewing while the student reads the printed text 112 which describes the object. This enhances the student's learning by allowing the student to see the actual object rather than a picture which may not adequately describe the object. In this type of use, the storage compartment may come sealed without optional access port 110.

The data entry field may also be erasable to allow reuse of the integral leaf once a particular project is over. This reduces costs for the user by allowing the book 100 to be reused. In addition, the book 100 is shown as a conventional bound volume. However, those skilled in the art will recognize that any suitable assembly method, such as loose leaf construction, can also be used. Likewise, the figures show a single storage compartment 108 and data entry area 106 on the integral leaf 102 for ease of illustration. In practice, any number of data entry areas 106 or storage compartments 108 can be placed on the integral leaf 102 as can comfortably fit.

Figure 2:
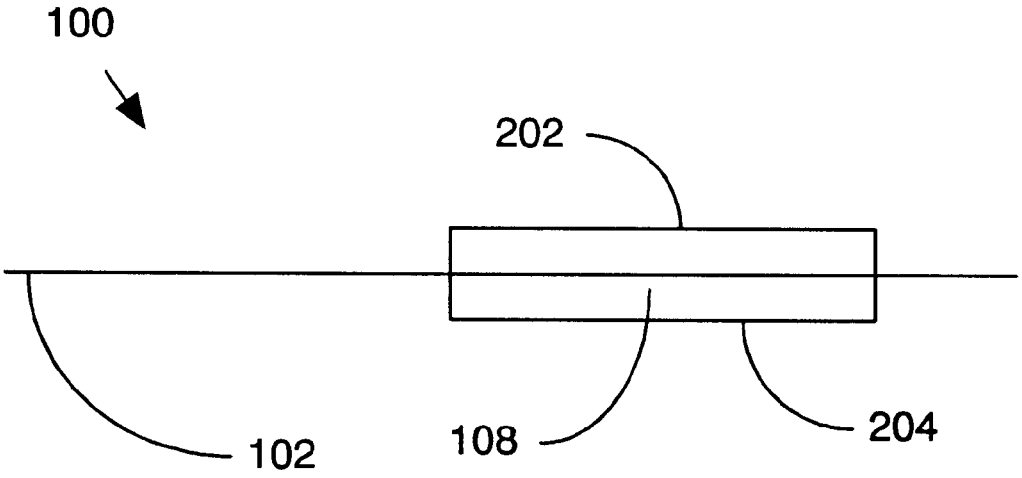
FIG. 2 is a top edge view of an alternative embodiment showing the integral leaf with a storage compartment that is exposed on both sides of the integral leaf.

In FIG. 2, an alternative embodiment showing a top edge view of the integral leaf 102 in which the storage compartment 108 is exposed on both sides of the integral leaf. The storage compartment 108 is shown in an expanded mode to accommodate three dimensional objects, but it may also be configured for two dimensional objects. This embodiment is particularly useful for collectibles or items which the user wants to observe from both sides. As can be seen, the storage compartment 108 has a front side 202 and a rear side 204 which are both transparent. When viewing collectibles, such as coins or baseball cards, both sides of the object have features which the collector may wish to observe. In addition, data entry areas 106 may be provided on both sides of integral leaf 102 such that comments related to a particular side of the object in the storage compartment 108 can be entered. Likewise, when used for teaching or scientific purposes, the stored object may have special features on each side which would require separate commentary in the data entry fields. Those skilled in the art will recognize that front side 202 and rear side 204 can be separated by an interior panel such that two separate compartments (not shown) are formed.

While the storage compartment 108 shown in FIG. 1 could be secured to the integral leaf 102 via techniques such as adhesive applied to the back or storage compartment 108, the storage compartment 108 shown in FIG. 2 would have to be sealed along at least one of its edges to allow its contents to be viewed from the front and rear sides. Likewise, the integral leaf 102 shown in FIG. 2 requires an aperture to allow storage compartment 108 to be seen from both sides. Storage compartment 102 can be sealed along one or more edges or secured in any other suitable matter.

Figure 3:
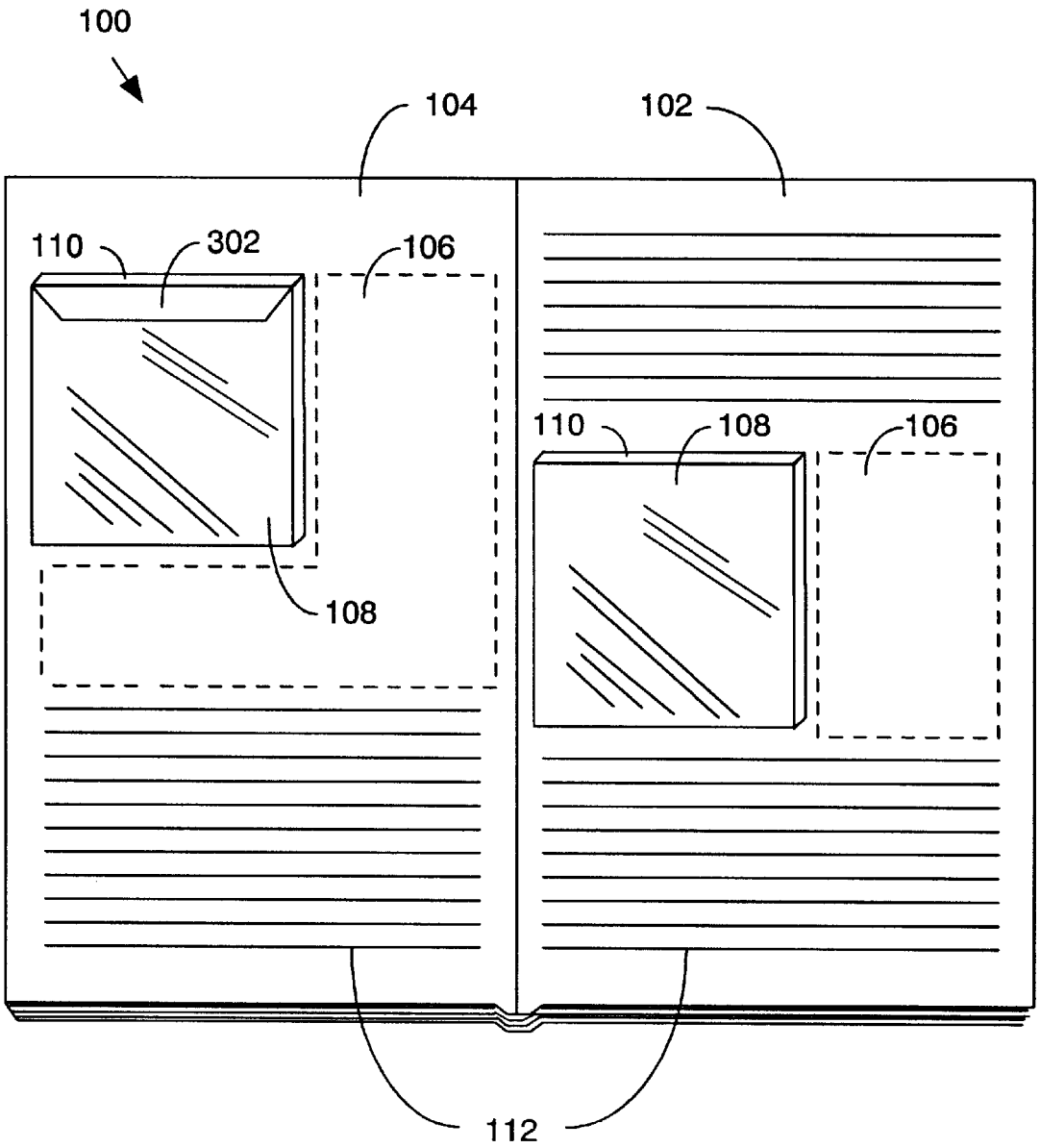
FIG. 3 is an alternative embodiment of the device showing integral storage compartments and data entry fields on opposing integral leafs with an optional sealable storage compartment on one leaf.

FIG. 3 shows an alternative embodiment of the book 100 in which one integral storage compartment 108 has an optional seal 302 which closes access port 110. Seal 302 is shown as a flap for ease of illustration. If a flap is used, sealing techniques such as hook and loop material may be used. However, any suitable sealing method may be used. The flap can be eliminated when using alternative sealing techniques such as commonly available Ziploc (™) type grooved seals.

A principle advantage of the book 100 is its ability to be used effectively in a variety of applications. The ability to securely store both two and three dimensional objects and to ensure that descriptive data is stored with the objects allows the book 100 to be effectively used as a teaching tool to help children learn to read or learn other subjects by increasing the level of their attention and their attention span. This is due to the ability to engage the reader by providing a variety of actual samples rather than the photographs typically found in textbooks. The ability to store evidence and commentary in the same place and to organize multiple evidence samples provides a more effective way to handle legal issues.

Likewise, the ability to store medical and scientific samples in a manner that allows the user to view both sides of the sample and to have separate commentary on each side of the sample provides for more effective research and education.

Figure 4:
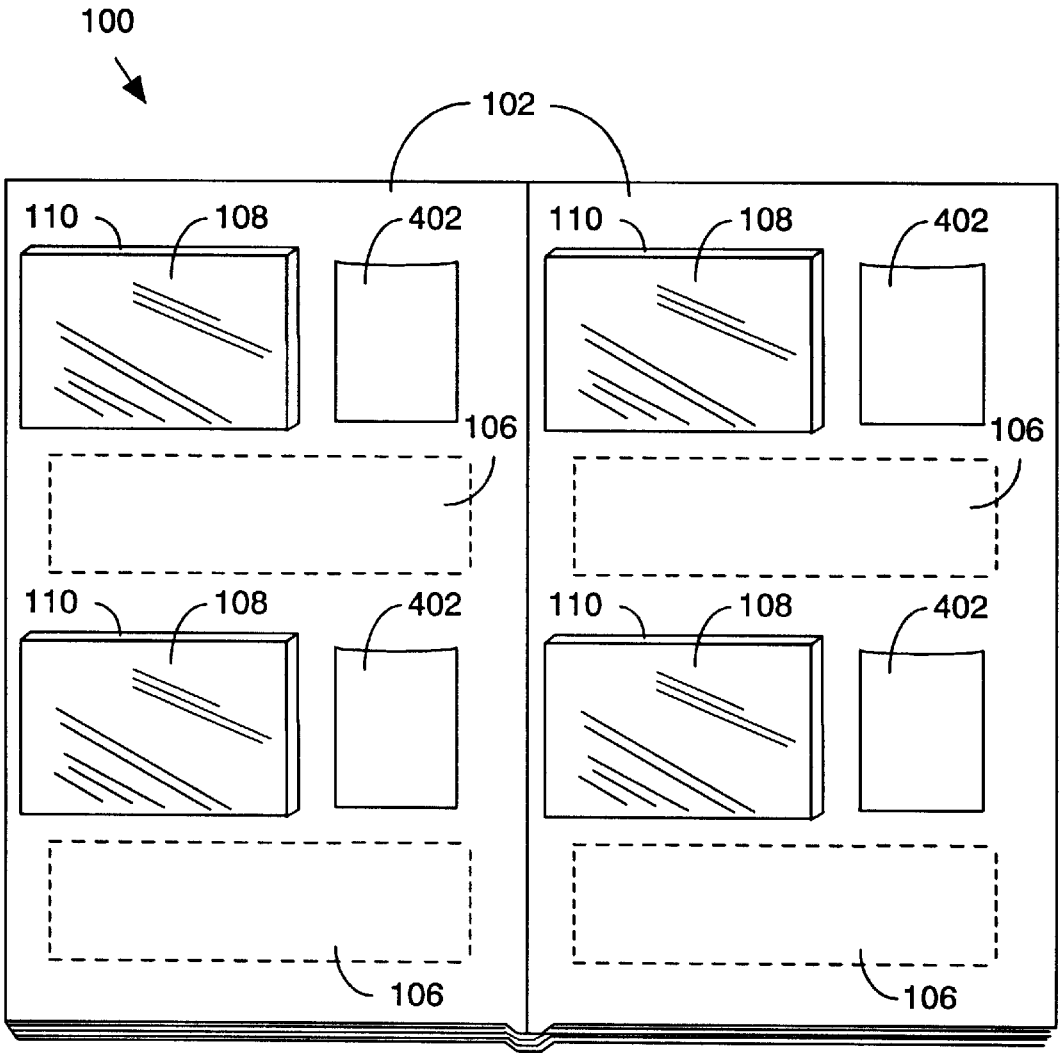
FIG. 4 is another alternative embodiment of the device showing integral storage compartments, data entry fields and document sleeve.

FIG. 4 is another alternative embodiment of the device showing integral storage compartments 108, data entry fields 106 and document sleeve 402. This integral leaf 102 is designed for collectible items, school yearbooks, diaries, etc. It provides a sleeve 402 adjacent the storage compartment 108 and data entry field 106. Sleeve 402 provides storage for flat data sheets or photographs while storage compartment 108 provides storage for three dimensional objects. The combination of storage for three dimensional objects, two dimensional objects, and a writable data entry field 106 can be used in a variety of applications. For example, when used with diaries or school yearbooks, it allows mementoes and associated photos to be stored safely. Likewise, for scientific materials, notes, photos and actual samples can be displayed and stored in the same place.

Figure 5A:
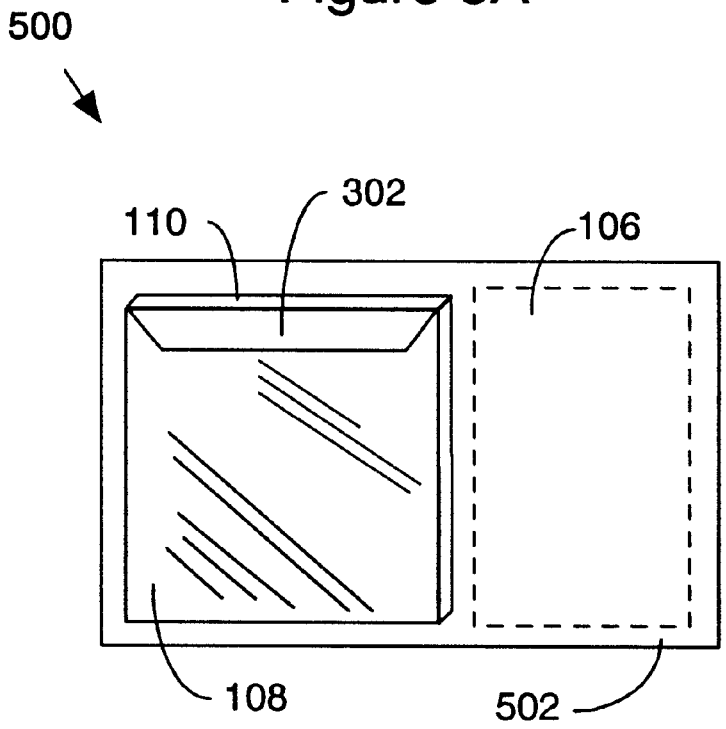
FIG. 5A is a further alternative embodiment in which the integral storage compartment and data entry field are mounted on a separate substrate which is capable of attachment to a conventional page leaf.
Figure 5B:
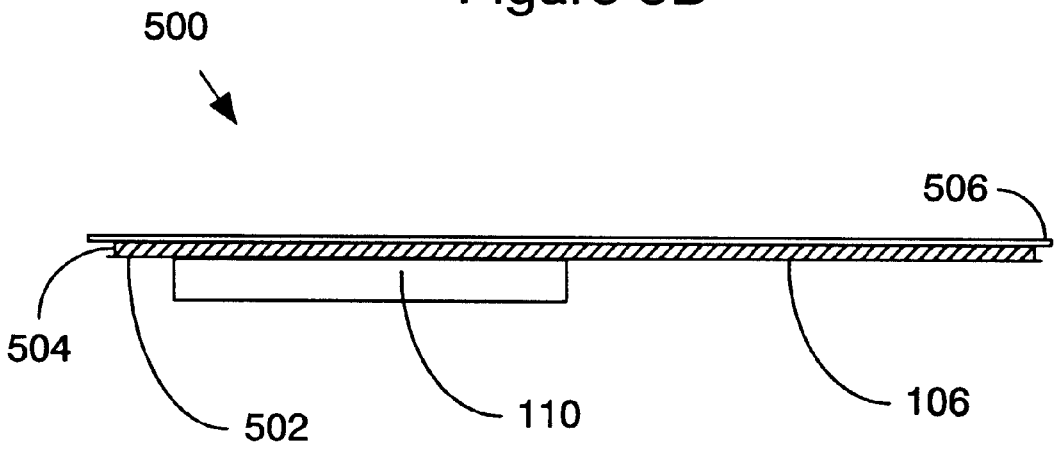
FIG. 5B is a top view of the embodiment of FIG. 5A which shows the adhesive layer used to attach the substrate to a conventional page leaf.
Figure 5C:
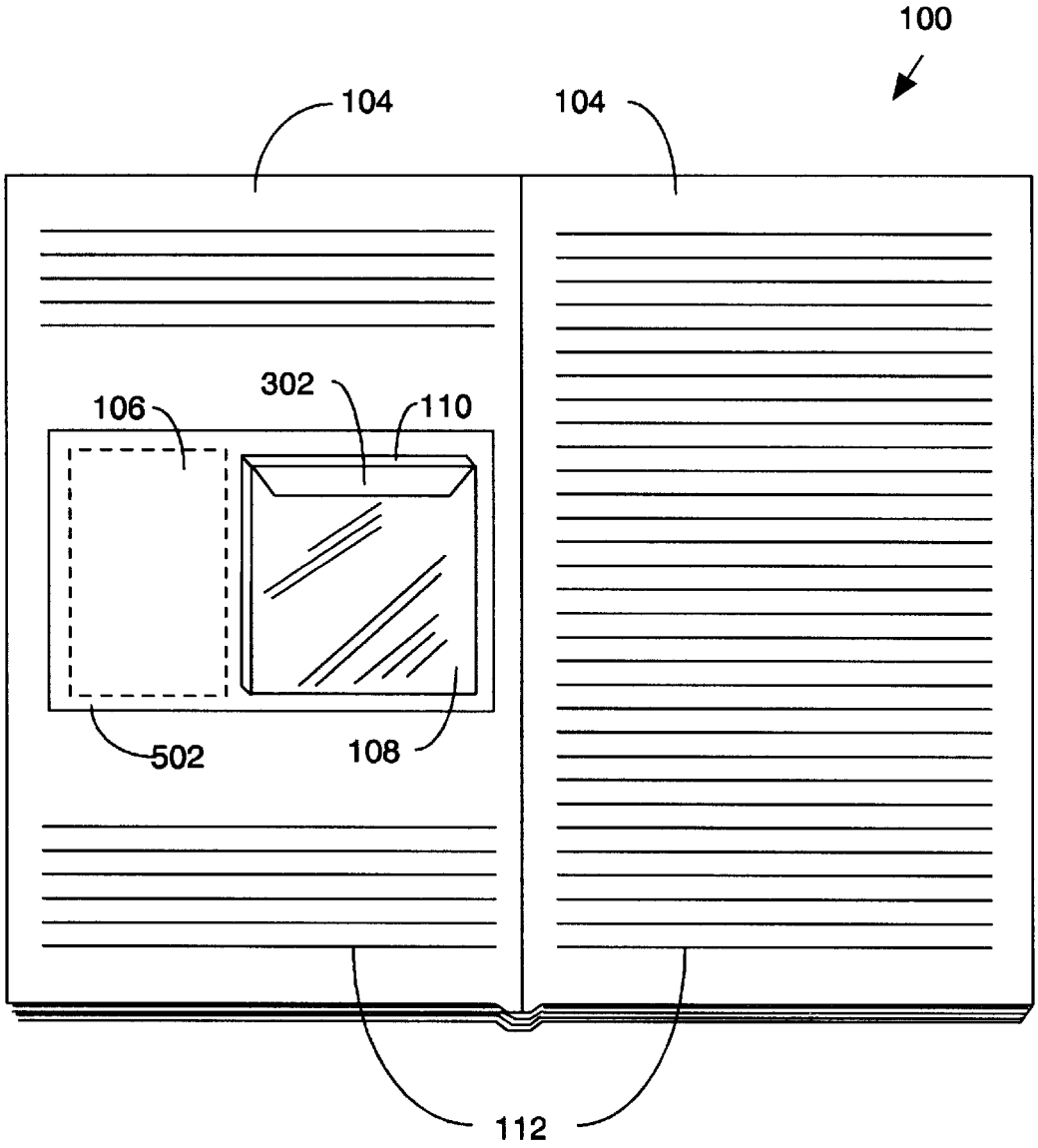
FIG. 5C illustrates the embodiment of FIG. 5A in which the substrate is attached to a conventional book page leaf.

FIG. 5A is another alternative embodiment in which a mountable storage assembly 500 which includes an integral storage compartment 108 and an optional data entry field 106 are mounted on a separate substrate 502 which is capable of attachment to a conventional page leaf (shown in FIG. 5C). The advantage of this embodiment is that it allows the integral storage compartment 108 to be added to a conventional page. This is particularly useful for books such as diaries in which the user may wish to occasionally store mementos of a special occasion. Likewise it is also useful for collectibles, such as stamps or coins. For scientific or research projects, it allows samples to be placed in a book at the user's convenience.

FIG. 5B is a top edge view of the embodiment of FIG. 5A which shows a substrate attachment 504, on the lower surface of substrate 502, for securing the substrate 502 to a book leaf 104. An optional access port 110 on storage compartment 108 is shown on the upper surface of substrate 502. In the preferred embodiment, the securing means 504 is an adhesive layer that is used to attach the substrate 502 to a conventional page leaf 104 (shown in FIG. 5C). In the preferred embodiment, the adhesive is protected by a conventional peel-off cover 506 which is well known in the art. The advantage of this type of attachment is that is it not visible to the user's eye once installed. However, those skilled in the art will recognize that any suitable means may be used to secure the substrate 502 to the page, such as adhesive, glue, double stick tape, staples, etc. For example, double stick tape may be used to attach the substrate from the bottom surface of the substrate, conventional tape may be used to attach the substrate from the top surface of the substrate, etc.

The substrate 502 may be rigid or flexible, but is preferably flexible for greater ease of use. In addition, substrate 502 may be fabricated from any suitable material, such as paper, plastic, polyethylene, polypropylene, etc. The material selected would be that most suitable for the particular type of book it is used with.

FIG. 5C illustrates the substrate 502 attached to a conventional book leaf 104. The advantage of the attachable integral storage compartment 108 shown in this embodiment is that it allows a conventional book to be converted into a multiple media storage device by attachment of the substrate 502 to a conventional book leaf 104. This provides the user with greater flexibility since the user can determine the location of the integral storage compartment 108 on the book leaf 104.

A principle advantage of the foregoing embodiments is their ability to store and present information in a variety of forms, including a mix of two and three dimensional objects in addition to narrative descriptions of the objects. The applications described above are exemplary of the numerous applications which would benefit from the ability to store multiple media types in a single page leaf structure.

While the invention has been described with respect to a preferred embodiment thereof, it will be understood by those skilled in the art that various changes in detail may be made therein without departing from the spirit, scope, and teaching of the invention. For example, the material used to construct the book may be anything suitable for its intended subject matter, the size and shape of the book will also vary based on the subject matter. The sealing method used to seal the storage compartment can vary along with the attachment method used to secure the storage compartment to the integral leaf. Accordingly, the invention herein disclosed is to be limited only as specified in the following claims.

I claim:

1. A multiple media storage device for use with a book leaf, comprising:

a substrate;

at least one writable data entry field on the upper surface of the substrate;

substrate attachment means for attachment of the substrate to a book leaf;

a first storage compartment attached to the upper surface of the substrate; and a second storage compartment on the upper surface of the substrate, the first storage compartment sized to accept three dimensional objects and the second storage compartment sized to accept substantially flat objects;

whereby the storage compartment can be attached to a book leaf.

2. A device, as in claim 1, wherein the first storage compartment contains a three dimensional object which is sealed within it.

3. A device, as in claim 1, wherein the first storage compartment is expandable to accept three dimensional objects and further comprises a resealable seal, the resealable seal sized to allow insertion and removal of objects into the first storage compartment and sealable to secure the objects within the first storage compartment;

whereby objects can be sealed within the storage compartment.

4. A multiple media storage device for use with a book leaf, comprising;

a substrate;

substrate attachment means for attachment of the substrate to a book leaf;

a first storage compartment attached to the upper surface of the substrate, the first storage compartment is expandable to accept three dimensional objects and further comprises a resealable seal, the resealable seal sized to allow insertion and removal of objects into the first storage compartment and sealable to secure the objects within the first storage compartment; and a second storage compartment on the upper surface of the substrate, the first storage compartment sized to accept three dimensional objects and the second storage compartment sized to accept substantially flat objects;

whereby the storage compartment can be attached to a book leaf.

5. A device, as in claim 4, further comprising at least one writable data entry field on the upper surface of the substrate.

6. A method of adding multiple media storage to a book leaf, including the steps of;

attaching a first storage compartment to a substrate;

attaching the substrate to a book leaf;

locating at least one writable data entry field on the surface of the substrate and attaching a second storage compartment on the upper surface of the substrate, the first storage compartment sized to accept three dimensional objects and the second storage compartment sized to accept substantially flat objects;

whereby the storage compartment can be attached to a book leaf.

7. A method, as in claim 6, including the further step of forming the substrate such that the substrate forms a book leaf;

whereby the storage compartment is an integral part of the book leaf.

8. A method, as in claim 6, including the further step of sealing a three dimensional object within the first storage compartment.

9. A method, as in claim 6, including the further steps of:

using an expandable first storage compartment to accept three dimensional objects; and using a resealable seal, the resealable seal sized to allow insertion and removal of objects into the first storage compartment and sealable to secure the objects within the first storage compartment;

whereby objects can be sealed within the storage compartment.

* * * * *